US005482646A

United States Patent [19]

Mazzola

[11] Patent Number: 5,482,646

[45] **Date of Patent: * Jan. 9, 1996**

[54] POWDER DETERGENT COMPOSITION FOR COLD WATER LAUNDERING OF FABRICS

[75] Inventor: Louis R. Mazzola, Mahwah, N.J.

[73] Assignee: Church & Dwight Co., Inc., Princeton, N.J.

[ * ] Notice: The portion of the term of this patent subsequent to Aug. 21, 2012, has been disclaimed.

[21] Appl. No.: 243,081

[22] Filed: May 16, 1994

Related U.S. Application Data

[63] Continuation of Ser. No. 27,197, Mar. 5, 1993, abandoned.

[51] Int. Cl.[6] ..... C11D 17/06; C11D 3/10; C11D 9/12; C11D 11/00

[52] U.S. Cl. ..... 252/174.13; 252/89.1; 252/108; 252/109; 252/121; 252/132; 252/133; 252/174; 252/174.14; 252/174.21; 252/531; 252/532; 252/534; 252/539; 252/540; 252/550; 252/551; 252/553; 252/558; 252/559

[58] Field of Search ..... 252/174.13, 174, 252/108, 109, 121, 132, 133, 531, 532, 534, 539, 540, 550, 551, 553, 558, 559, 174.21, 174.14, 89.1

[56] References Cited

U.S. PATENT DOCUMENTS

| | | | |
|---|---|---|---|
| 3,664,962 | 5/1972 | Kelly et al. | 252/125 |
| 3,863,336 | 2/1975 | Mazzola et al. | 252/527 |
| 3,908,045 | 9/1975 | Alterman et al. | 427/213 |
| 4,196,095 | 4/1980 | Cala et al. | 252/140 |
| 4,530,774 | 7/1985 | Davies et al. | 252/108 |
| 4,695,284 | 9/1987 | Hight | 8/137 |
| 4,731,195 | 3/1988 | Olson | 252/174.13 |
| 4,824,593 | 4/1989 | Appel et al. | 252/127 |
| 5,008,029 | 4/1991 | Carmello et al. | 252/91 |

*Primary Examiner*—Paul Lieberman
*Assistant Examiner*—Ardith Hertzog
*Attorney, Agent, or Firm*—Charles B. Barris

[57] ABSTRACT

This invention provides a powder carbonate-based laundry detergent which can be utilized in cold water fabric laundering with a minimized remainder of undissolved detergent residue in the wash water.

A particulate anionic surfactant ingredient such as sodium lauryl sulfate is incorporated by dry blending with detergent granules to form an adherent coating of fine particles of anionic surfactant on the detergent granules, in a quantity which is effective for reducing the residue of undissolved detergent under cold water laundering conditions.

5 Claims, 3 Drawing Sheets

POWDER DETERGENT COMPOSITION FOR COLD WATER LAUNDERING OF FABRICS

CROSS-REFERENCE TO RELATED PATENT APPLICATION

This application is a continuation of application Ser. No. 08/027,197, filed Mar. 5, 1993, now abandoned.

The subject matter of this patent application is related to that disclosed in patent application Ser. No. 08/244,460, a continuation of Ser. No. 08/027,198, filed Mar. 5, 1993, now abandoned.

BACKGROUND OF THE INVENTION

Heavy duty powder detergent compositions for home use fabric laundering generally perform well and are widely accepted. With the increasing trend to cold Water washing of fabrics at wash water temperatures below about 60° F. for energy conservation, commercial laundry detergent compositions tend to leave a cold water residue (CWR) of undissolved detergent solids after completion of the wash machine cycles.

The detergency of powder detergent compositions in fabric laundering applications is directly affected by the hardness of the wash water. Control of water hardness typically is achieved with detergency builders, such as water-soluble sequestering builders, water-insoluble ion exchange builders, and water-soluble precipitating builders.

Sodium carbonate is a preferred detergent builder because of cost considerations, but it has inherent disadvantages. Sodium carbonate alone is not capable of reducing the calcium ion concentration in hard water to a level sufficient to provide high detergency under conventional fabric washing conditions. Also, precipitated calcium carbonate tends to coat undissolved detergent particles.

Particularly in the case of cold water laundering of fabrics, the coating of detergent particles with precipitated calcium carbonate suppresses dissolution of the sodium carbonate ingredient. This results in a substantial loss of detergency building activity, and there is a consequential remainder of a cold water residue of undissolved detergent solids.

Laundry detergent formulations which have been developed for use in cold water washing of fabrics are described in U.S. Pat. Nos. 4,196,095; 4,530,774; and 4,695,284.

There is continuing interest in the development of heavy duty laundry detergents which exhibit improved properties for cold water laundry applications.

Accordingly, it is an object of this invention to provide a powder detergent composition which performs with a minimized amount of residual undissolved detergent solids under cold water fabric laundering conditions.

It is a further object of this invention to provide a process for producing a powder detergent composition which has detergent granules coated with an anionic surfactant ingredient.

Other objects and advantages of the present invention shall become apparent from the accompanying description and examples.

DESCRIPTION OF THE INVENTION

One or more objects of the present invention are accomplished by the provision of a laundry detergent composition which is a granulated blend of ingredients comprising (a) between about 40–90 weight percent of a water-soluble inorganic salt detergent builder ingredient, wherein at least one third of the inorganic salt detergent builder ingredient is sodium carbonate; (b) between about 5–40 weight percent of detergent active ingredient; and (c) between about 0–15 weight percent of alkali metal silicate; and between about 0.7–5 weight percent of a particulate anionic surfactant ingredient which is coated on the surfaces of the detergent granules, and wherein the anionic surfactant ingredient is selected from alkali metal and ammonium salts of $C_8$–$C_{22}$ aliphatic containing acidic compounds, having an average particle size between about 10–300 microns.

Suitable water-soluble inorganic salt detergent builder compounds include alkali metal and ammonium carbonates, bicarbonates, sesquicarbonates, silicates, phosphates, orthophosphates, pyrophosphates, tripolyphosphates, silicates, borates, and the like. Sodium and potassium carbonates, bicarbonates, sesquicarbonates and tripolyphosphates are illustrative of preferred types of inorganic salt detergent builder compounds.

The term "water-soluble" as employed herein refers to a chemical compound which as a solubility of at least about 2 grams per 100 grams of water at 25° C.

The detergent active ingredient preferably is selected from anionic and nonionic $C_8$–$C_{22}$ aliphatic-containing compounds.

Suitable anionic detergent active compounds include water-dispersible alkali metal and ammonium salts of organic sulfates and sulfonates containing an alkyl radical of 8–22 carbon atoms. Illustrative of anionic compounds are sodium, potassium and ammonium salts of straight chain $C_{10}$–$C_{18}$ alkyl sulfates, $C_{10}$–$C_{18}$ alkyl ether sulfates (1–10 oxyalkylene groups), $C_{10}$–$C_{18}$ alkylbenzene-sulfonates, and any mixture thereof.

Other anionic detergent active compounds include alkyl glycerol ether sulfonate salts; fatty acid monoglyceride sulfate salts; alkyl sulfosuccinate salts such as disodium lauryl sulfosuccinate; and the like.

Suitable nonionic detergent active compounds include aliphatic alcohols, acids, amides and alkylphenols containing 8–28 carbon atoms, and additional alkylene oxide groups. Illustrative of preferred nonionic compounds are linear primary or secondary $C_{12}$–$C_{15}$ monohydric alcohols which are ethoxylated with 3–15 ethylene oxide units, and $C_8$–$C_{16}$ alkylphenols ethoxylated with 4–12 ethylene oxide units per molecule.

Other nonionic detergent active compounds include long chain tertiary amine oxides, long chain tertiary phosphine oxides and dialkyl sulfoxides, and the like.

Anionic compounds which are suitable as the particulate surfactant for coating the detergent granules include sodium, potassium and ammonium salts of $C_{12}$–$C_{22}$ fatty acid, $C_{10}$–$C_{18}$ alkyl sulfate, ethoxylated $C_{10}$–$C_{18}$ alkyl ether sulfate, or any mixture thereof; and preferably the anionic surfactant ingredient is a particulate solid having an average particle size between about 50–200 microns.

A present invention laundry detergent composition can contain other optional detergent adjuncts, which include lather boosters such as alkanolamines, lather depressants such as alkyl phosphates or silicones, anti-redeposition agents such as sodium carboxymethylcellulose, oxygen-releasing bleaching agents such as sodium perborate or sodium percarbonate, fabric softening agents, fluorescent agents, perfumes, enzymes, germicides, colorants, and the like.

A preferred type of anti-redeposition agent is sodium polyacrylate having a molecular weight of 10,000–50,000.

It is generally desirable to include a sodium or potassium silicate ingredient in the laundry detergent composition to provide buffering capacity and to prevent corrosion of metal parts in washing machines.

In another embodiment this invention provides a process for producing a powder detergent composition which comprises (1) forming a granulated blend of ingredients comprising (a) between about 40–90 weight percent of a water-soluble inorganic salt detergent builder ingredient, wherein at least one third of the inorganic salt detergent builder ingredient is sodium carbonate, (b) between about 5–40 weight percent of detergent active ingredient, and (c) between about 0–15 weight percent of alkali metal silicate; and (2) dry mixing the detergent blend granules with between about 0.7–5 weight percent of a particulate anionic surfactant ingredient selected from alkali metal and ammonium salts of $C_8$–$C_{22}$ aliphatic-containing acidic compounds having an average particle size between about 10–300 microns, thereby forming an adherent coating on the surfaces of the detergent blend granules.

The particulate builder, and other main ingredients are blended in an initial procedure. The blend then is agglomerated in a rotary drum, inclined pan or paddle-type mixer with water spraying to form agglomerated detergent solids. The detergent granules preferably have a bulk density between about 700–1050 grams/liter.

The detergent granules then are dry blended with the fine anionic surfactant ingredient and other minor ingredients for a period of about 2–10 minutes. The final detergent composition consists of detergent blend granules which have an adherent coating of fine particles of anionic surfactant ingredient on the surfaces of the detergent blend granules.

The anionic surfactant coating has a direct effect on the quantity of cold water residue of detergent solids which remain undissolved when the powder detergent composition is employed for cold water fabric washing under home use conditions.

After a laundry load and detergent powder are placed in a home wash machine, the initial wash water normally is added to the wash machine contents over a period of about five minutes. The machine agitator is off during the initial wash water addition, thereby providing a relatively static medium around the detergent particles. This is a critical phase of the laundering operation with respect to the eventual quantity of cold water residue which remains undissolved.

With conventional laundry detergents, the water hardness causes a precipitate of calcium carbonate to form a water-insoluble coating on the surfaces of the detergent granules, which decreases dissolution of the sodium carbonate contained in the core of the calcium carbonate coated detergent granules. This has the effect of limiting the detergency power of the detergent active ingredients, and increasing the quantity of cold water residue remaining after completion of the laundering cycles.

A present invention laundry detergent composition can be utilized in cold water fabric washing under home use conditions with little or no cold water residue remaining after completion of the laundering cycles. It appears that the anionic surfactant coating on the detergent granules functions as a barrier, and prevents the formation and deposition of calcium carbonate as a coating on detergent granule surfaces. As water molecules penetrate the particulate anionic surfactant coating on the detergent granules, anionic surfactant calcium salt is formed in the anionic surfactant coating, and softened water passes through the anionic surfactant coating and dissolves the core sodium carbonate of the detergent granules.

The immediate effect is to establish and maintain an exclusive zone of softened water in contact with the detergent granule surfaces in the wash machine, during the initial wash water filling stage. This results in more rapid solvation of the detergent solids, an enhancement of detergency activity, and a reduction or elimination of any cold water residue of undissolved detergent solids.

The following examples are further illustrative of the present invention. The components and specific ingredients are presented as being typical, and various modifications can be derived in view of the foregoing disclosure within the scope of the invention.

EXAMPLE I

This Example illustrates reduction of cold water residue in fabric washing with a powder detergent composition in accordance with the present invention.

Control Formulation

| | Parts By Weight |
|---|---|
| sodium carbonate | 81.9 |
| sodium Neodol 25-3 sulfate(1) | 4.3 |
| Neodol 25-3 | 2.4 |
| sodium sulfate | 1.5 |
| sodium bicarbonate | 1.3 |
| Acusol 912N(2) | 0.7 |
| sodium carboxymethylcellulose(3) | 0.1 |
| optical brightener | 0.2 |
| perfume | 0.1 |
| polyvinyl alcohol(4) | 0.1 |
| water | 7.4 |

(1)Ethoxylated $C_{12}$–$C_{15}$ alcohol sulfate salt (Shell Chemical Company).
(2)Sodium polyacrylate; Rohm & Haas
(3)Finetex Inc.
(4)M.W. 15,000–30,000; Airco.

Invention Formulation

| | Parts By Weight |
|---|---|
| sodium carbonate | 81.9 |
| sodium Neodol 25-3 sulfate | 4.3 |
| Neodol 25-3 | 2.4 |
| sodium sulfate | 1.5 |
| sodium bicarbonate | 1.3 |
| polymer solids | 0.7 |
| sodium carboxymethylcellulose | 0.1 |
| optical brightener | 0.2 |
| perfume | 0.1 |
| polyvinyl alcohol | 0.1 |
| water | 7.4 |
| sodium stearate | 0.25–10 |

In preparing the formulations, the detergent ingredients, except the sodium stearate, are dry blended and agglomerated with sprayed water. The granules have an average diameter of 500 microns, and bulk density of 912 grams/liter. The sodium stearate (average particle size of 90–110 microns) is added as the last ingredient by dry blending for three minutes to form an adherent coating of sodium stearate on the detergent blend granules.

A standard Kenmore home use washing machine is employed for the comparative tests.

A 113 gram quantity of detergent formulations is placed in the washing machine. A five pound load of fabrics is added. The machine is run through wash and rinse cycles with a water temperature of 40° F. At the end of the spin cycle, any remaining detergent is retrieved and weighed.

Figure 1:
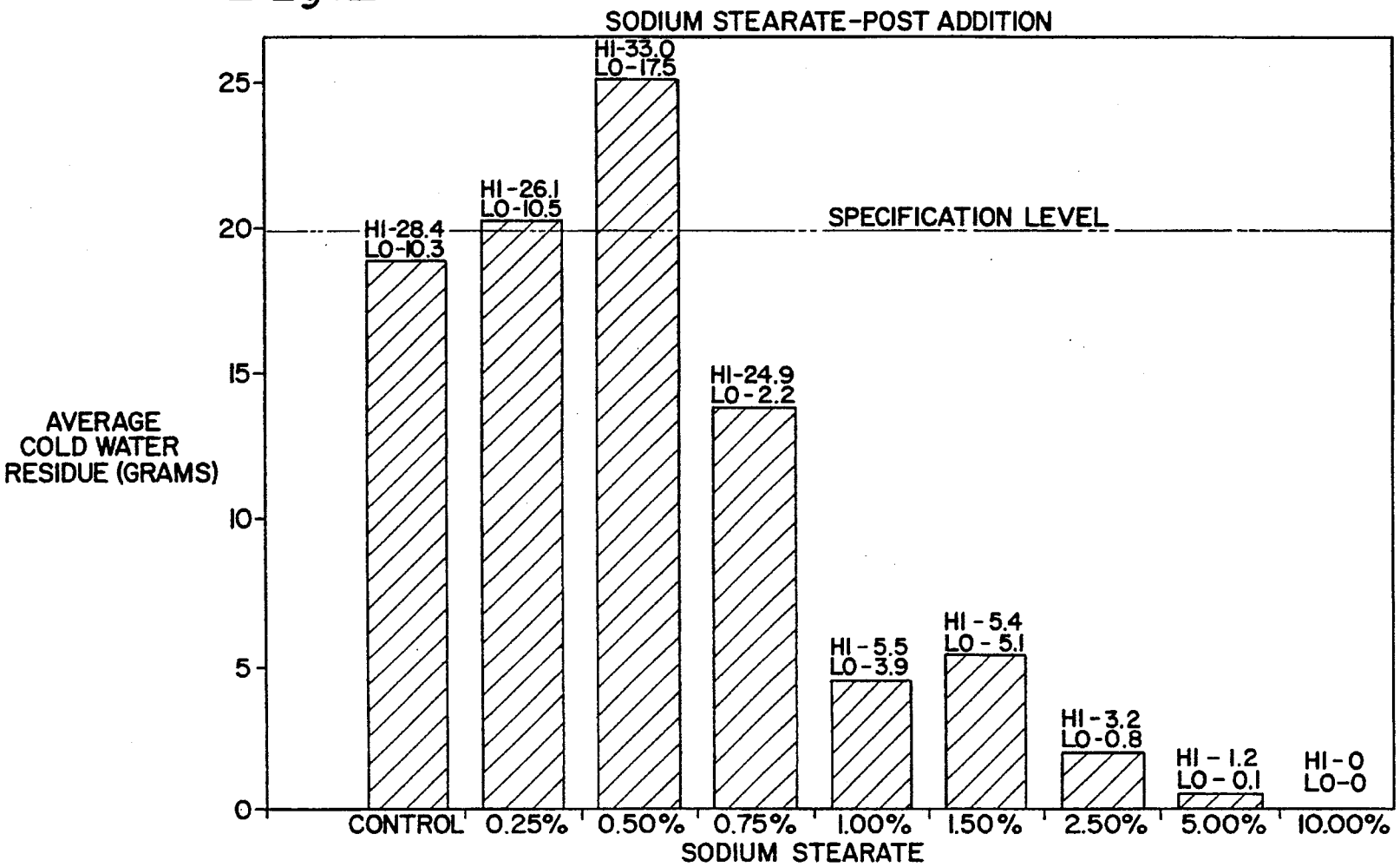
FIG. 1 is a graphic representation of average cold water residue of detergent solids which have a surface coating of varied concentration of post-addition sodium stearate.

FIG. 1 is a summary of comparative results. The data for each formulation represent the average of several runs. The standard specification is indicated as 20 grams under the testing conditions.

The data demonstrate that an invention detergent formulation containing above about 0.7 weight percent of a surface-coating of sodium stearate is effective for reducing the cold water residue (CWR) of detergent solids under conventional home use fabric washing conditions using relatively cool water.

EXAMPLE II

This Example illustrates the superior results obtained when sodium stearate is utilized as a laundry detergent post-additive in comparison with calcium stearate for reduction of cold water residue under fabric washing conditions.

The procedures of Example I are followed for the preparation of detergent formulations, and for the testing of the formulations under cold water fabric laundering conditions.

In the formulations containing sodium stearate, calcium stearate or zeolite A (Valfore 100, PQ Corporation), the additive compound is added as a last ingredient with three minutes of dry blending to form an adherent coating of fine additive particles on the larger detergent blend granules.

Figure 2:
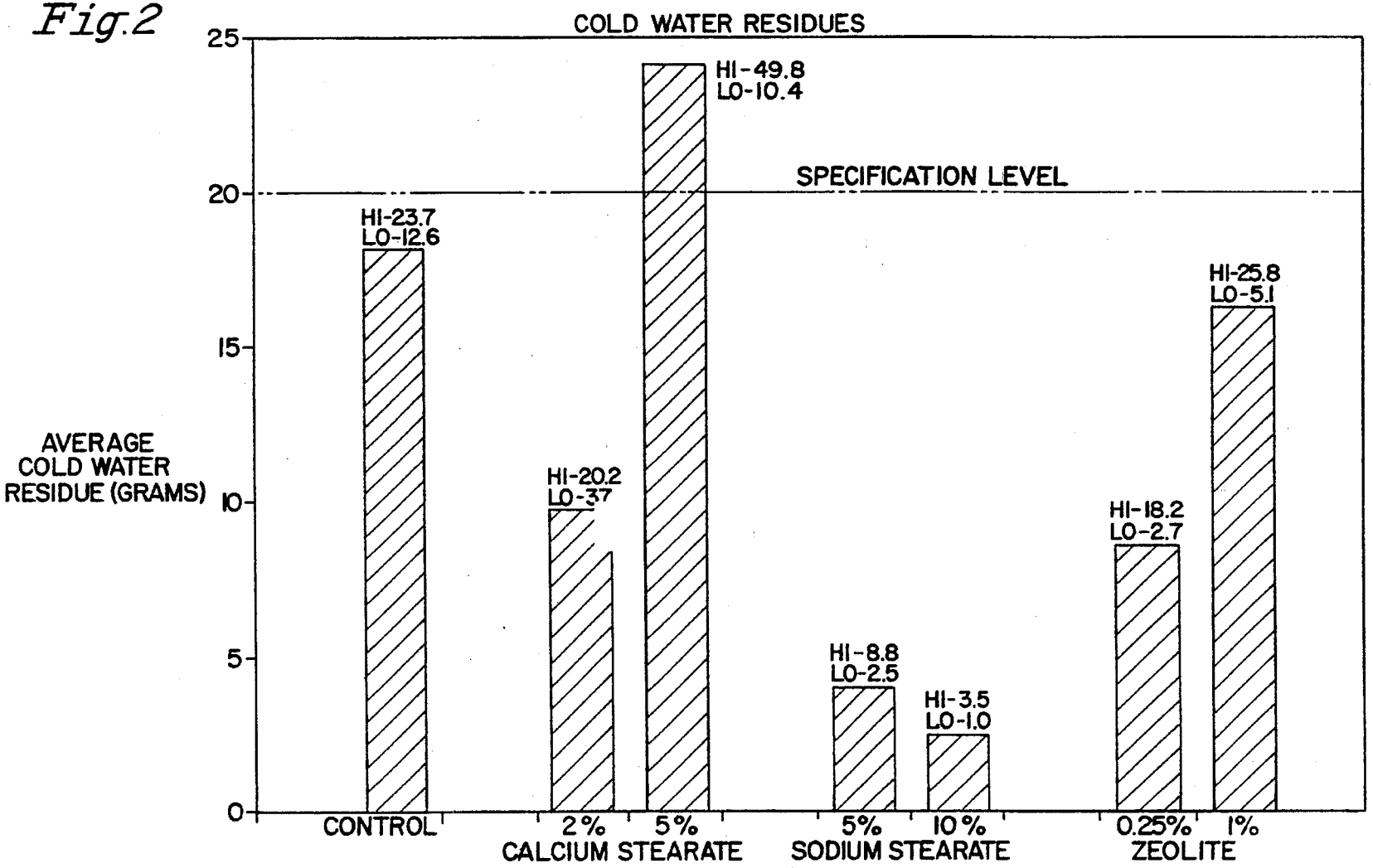
FIG. 2 is a graphic representation of average cold water residue of detergent solids which have a surface coating of a selected post-addition compound.

FIG. 2 is a summary of comparative results. The data demonstrate that sodium stearate is more effective than calcium stearate or zeolite A for reducing the cold water residue of detergent solids under fabric washing conditions.

EXAMPLE III

This Example illustrates the dissolution rate of an invention detergent composition in accordance with the present invention.

An invention detergent formulation similar to that described in Example I is tested for dissolution rate by measuring the conductivity of an aqueous solution containing the detergent.

The detergent solubility rate is measured with a conductance meter (YSI model 32 with ATP). A jacketed beaker (40° F.) is filled with two liters of tap water. A 3.54 gram quantity of detergent sample is added to the beaker medium, and the medium is stirred. A conductance probe (YSI model 3403) is employed to monitor the conductivity of the medium up to a maxamium reading, and the conductivity is correlated with weight percent of dissolved detergent.

Figure 3:
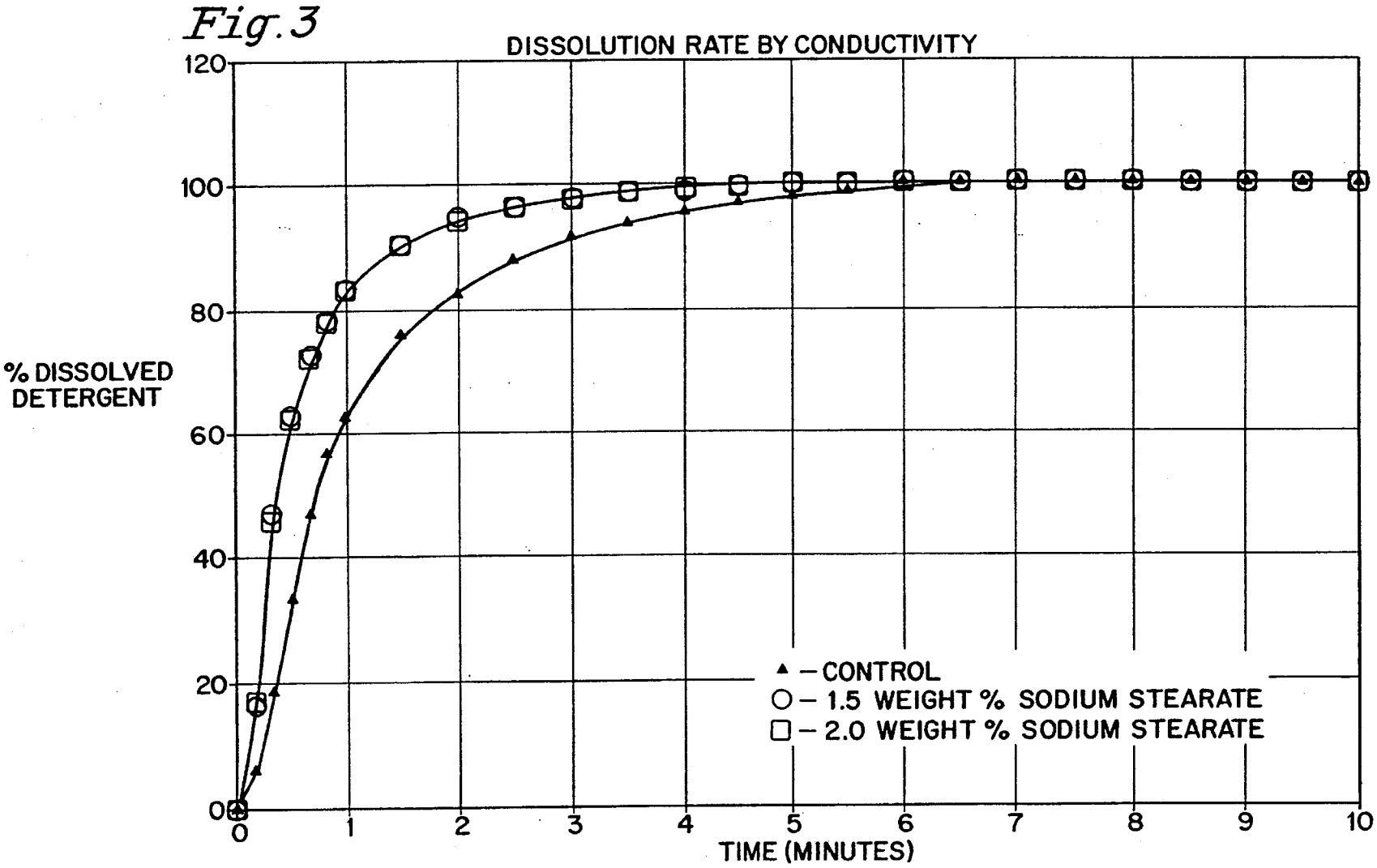
FIG. 3 is a graphic representation of detergent dissolution rate as determined by conductivity measurement of the aqueous medium. The graph illustrates a control detergent in comparison with a sodium stearate-coated detergent.

FIG. 3 is a graphic representation of the detergent dissolution rate by conductivity measurement.

EXAMPLE IV

This Example illustrates the reduction of cold water residue in fabric washing with a powder detergent composition in accordance with the present invention.

The following compositions are formulated and tested for cold water residue under fabric washing conditions.

A.

| | Parts By Weight |
|---|---|
| Sodium Carbonate | 68.50 |
| Sodium Alkylbenzenesulfonate | 6.30 |
| Ethoxylated Alcohol | 7.40 |
| Sodium Silicate | 5.10 |
| Sodium Phosphate | 2.60 |
| Sodium Carboxymethylcellulose | 0.10 |
| Sodium Sulfate | 1.00 |
| Water | 9.00 |

The granules have an average diameter of 609 microns, and a bulk density of 655 grams/liter. A cold water residue test indicates a residue weight of 15.5 grams.

When the same formulation has a 1.5 weight percent post-addition surface coating of sodium stearate, no cold water residue remains.

B.

| | Parts By Weight |
|---|---|
| Sodium Carbonate | 80.30 |
| Sodium Sulfate | 1.00 |
| Sodium Phosphate | 2.20 |
| Sodium Silicate | 3.30 |
| Sodium Carboxymethylcellulose | 0.10 |
| Ethoxylated Alcohol | 5.00 |
| Water | 8.10 |

The granules have an average particle diameter of 515 microns, and a bulk density of 905 grams/liter. A cold water residue test indicates a residue weight of 27.5 grams.

When the same formulation has a 2.5 weight percent post-addition surface coating of sodium stearate, no cold water residue remains.

What is claimed is:

1. A laundry detergent composition which is a granulated blend of ingredients comprising (a) between about 40–90 weight percent of a water-soluble inorganic salt detergent builder ingredient wherein at least one third of the inorganic salt detergent builder ingredient is sodium carbonate, and (b) between about 5–40 weight percent of detergent active ingredient which comprises sodium, potassium or ammonium salt of linear $C_{10}$–$C_{18}$ alkylbenzenesulfonate, sodium, potassium or ammonium salt of $C_{10}$–$C_{18}$ alkyl sulfate or ethoxylated $C_{10}$–$C_{18}$ alkyl ether sulfate, or $C_{12}$–$C_{15}$ monohydric alcohol ethoxylated with 3–15 ethylene oxide units per molecule or any mixture thereof; and between about 0.7–5 weight percent of a particulate anionic surfactant ingredient coating on the surfaces of the detergent granules, and wherein the anionic surfactant ingredient consists of sodium, potassium or ammonium salt of $C_{12}$–$C_{22}$ fatty acid or $C_{10}$–$C_{18}$ alkyl sulfate or ethoxylated $C_{10}$–$C_{18}$ alkyl ether sulfate or any mixture thereof, and wherein the anionic surfactant ingredient is a particulate solid having an average particle size between about 50–200 microns.

2. A powder detergent composition in accordance with claim 1 wherein the inorganic salt ingredient comprises a mixture of sodium bicarbonate and sodium carbonate.

3. A powder detergent composition in accordance with claim 1 wherein the inorganic salt ingredient comprises a mixture of sodium sesquicarbonate and sodium carbonate.

4. A powder detergent composition in accordance with claim 1 wherein the inorganic salt ingredient comprises a mixture of sodium tripolyphosphate and sodium carbonate.

5. A process for producing a powder detergent composition which comprises (1) forming a granulated blend of ingredients comprising (a) between about 40–90 weight percent of a water-soluble inorganic salt detergent builder ingredient wherein at least one third of the inorganic salt detergent builder ingredient is sodium carbonate, and (b) between about 5–40 weight percent of detergent active ingredient which comprises sodium, potassium or ammonium salt of linear $C_{10}$–$C_{18}$ alkylbenzenesulfonate, sodium, potassium or ammonium salt of $C_{10}$–$C_{18}$ alkyl sulfate or ethoxylated $C_{10}$–$C_{18}$ alkyl ether sulfate, or $C_{12}$–$C_{15}$ monohydric alcohol ethoxylated with 3–15 ethylene oxide units per molecule or any mixture thereof; and (2) dry mixing the detergent blend granules with between about 0.7–5 weight percent of a particulate anionic surfactant ingredient which consists of sodium, potassium or ammonium salt of $C_{12}$–$C_{22}$ fatty acid or $C_{10}$–$C_{18}$ alkyl ether sulfate or ethoxylated $C_{10}$–$C_{18}$ alkyl ether sulfate or any mixture thereof, and is a particulate solid having an average particle size between about 50–200 microns; thereby forming a particulate anionic surfactant ingredient coating on the surfaces of the detergent blend granules.

* * * * *